US005921875A

United States Patent [19]

Bickel

[11] Patent Number: 5,921,875

[45] Date of Patent: Jul. 13, 1999

[54] REDUCED WEIGHT ARROW POINT ADAPTER HAVING HIGH DENSITY GROOVE STRUCTURE

[76] Inventor: Wayne J. Bickel, Rte. 1, Box 241, Geneva, Ind. 46740

[21] Appl. No.: 08/868,642

[22] Filed: Jun. 4, 1997

Related U.S. Application Data

[60] Provisional application No. 60/020,418, Jun. 18, 1996.

[51] Int. Cl.[6] ..... F42B 6/04

[52] U.S. Cl. ..... 473/582; 403/299; 403/300

[58] Field of Search ..... 403/265, 299, 403/300; 473/578, 582, 583, FOR 216, FOR 219, FOR 221, FOR 222

[56] References Cited

U.S. PATENT DOCUMENTS

| | | | |
|---|---|---|---|
| 1,423,551 | 7/1922 | Adriance . | |
| 1,794,051 | 2/1931 | Allen . | |
| 2,209,672 | 7/1940 | Boggs . | |
| 2,747,876 | 5/1956 | Teller . | |
| 3,393,912 | 7/1968 | Lonais . | |
| 4,050,696 | 9/1977 | Troncoso . | |
| 4,141,554 | 2/1979 | Sherwin . | |
| 4,266,782 | 5/1981 | Patterson . | |
| 4,305,588 | 12/1981 | Dodge . | |
| 4,533,146 | 8/1985 | Schaar . | |
| 4,544,163 | 10/1985 | Seanlon . | |
| 4,547,837 | 10/1985 | Bennett | 362/186 |
| 4,645,211 | 2/1987 | Beiter . | |
| 4,671,517 | 6/1987 | Winters . | |
| 4,706,965 | 11/1987 | Schaar . | |
| 4,829,974 | 5/1989 | Anderson . | |
| 4,874,180 | 10/1989 | Fingerson . | |
| 4,943,067 | 7/1990 | Saunders . | |
| 5,067,731 | 11/1991 | Bickel . | |
| 5,154,432 | 10/1992 | Saunders . | |
| 5,234,220 | 8/1993 | Schellhammer . | |
| 5,306,019 | 4/1994 | Guest . | |
| 5,306,020 | 4/1994 | Bolf . | |
| 5,385,420 | 1/1995 | Newman et al. | 403/299 |
| 5,417,439 | 5/1995 | Bickel . | |
| 5,417,440 | 5/1995 | Barrie et al. | 473/584 |
| 5,439,231 | 8/1995 | Roberts et al. . | |
| 5,494,298 | 2/1996 | Maleski . | |

FOREIGN PATENT DOCUMENTS

| | | |
|---|---|---|
| 1 470 802 | 4/1977 | United Kingdom . |
| WO 89/03012 | 4/1989 | WIPO . |

OTHER PUBLICATIONS

Archer's Bible 1966–67, p. 74.
Nock Insert (Undated advertisement).
Percision Kwik Nock System, Saunders Archery.

*Primary Examiner*—John A. Ricci
*Attorney, Agent, or Firm*—Baker & Daniels

[57] ABSTRACT

An adapter for coupling an arrow point to an arrow shaft. The adapter comprises a first body member having an exterior surface extending from an inboard end to an outboard end. At least a first portion of the exterior surface of the first body member comprises a high density groove structure comprising a plurality of grooves having a groove density of at least 4-grooves per centimeter; and a plurality of shoulders spaced apart by the grooves, wherein the ratio of the total cumulative widths of the shoulders of the first portion to the total cumulative width of the grooves of the first portion is in the range of from 0:1 to about 3:1. The present invention provides an arrow assembly comprising such an adapter.

4 Claims, 4 Drawing Sheets

REDUCED WEIGHT ARROW POINT ADAPTER HAVING HIGH DENSITY GROOVE STRUCTURE

CROSS REFERENCE TO RELATED APPLICATIONS

This application claims the benefit under Title 35, U.S.C. §119(e) of U.S. provisional application Ser. No. 60/020,418, filed Jun. 18, 1996.

FIELD OF THE INVENTION

The present invention relates to an adapter for mounting an arrow point to an arrow shaft. More specifically, the present invention relates to such an adapter comprising first and second body members in which the first body member has a plurality of grooves and the second body member has a reduced diameter.

BACKGROUND OF THE INVENTION

Arrows include an arrow shaft having an arrow point attached to one end of the shaft and a nock, adapted to be received by a bow string, attached to the other end of the shaft. Arrow shafts may be fabricated from a wide variety of materials, including wood, metal such as aluminum, carbon, fiberglass, composites such as aluminum/carbon, and the like. Wood shafts are typically of a solid, substantially cylindrical construction, whereas shafts made from other materials are typically of a hollow, tubular construction.

Various approaches have been developed for attaching an arrow point to the hollow end portion of a tubular arrow shaft. In some approaches the arrow point is attached directly to the arrow shaft, and in other approaches the arrow point is attached to the arrow shaft indirectly through an adapter. Most arrows sold commercially today use the adapter approach for mounting arrow points.

One widely used type of adapter is designed to be inserted and glued into a hollow end portion of a tubular arrow shaft. This kind of adapter includes a bore for receiving the corresponding mounting portion of an arrow point. The body of such adapters may be provided with glue grooves in order to enhance bonding between the adapter and the arrow shaft. Examples of this class of adapter and corresponding arrow points are described in U.S. Pat. Nos. 4,943,067; 4,671,517; and 4,533,146. Such an adapter and corresponding arrow points are also described in the AMO Interchangeable Point System Standard. Some commercial embodiments of these adapters include glue grooves to receive glue used to bond the adapter in place.

When an adapter is inserted and glued into the hollow end portion of an arrow shaft, it is important that the glue bond be strong enough to hold the adapter in place and in proper alignment during shotmaking activities. For example, when an arrow impacts a target, is pulled from a target, or the like, it would be undesirable for the adapter to come loose or jar out of alignment. One factor affecting such bond strength is the amount of surface area of the adapter which is available for bonding engagement with the arrow shaft. In order to ensure adequate bond strength between a conventional adapter and an arrow shaft, a relatively large surface area of the conventional adapter is required for adequate bonding.

It is also important that the adapter be as lightweight as possible, while still maintaining sufficient structural strength to withstand impact and tugging forces experienced by the arrow during shotmaking activities. Various approaches have been proposed for reducing the weight of an adapter. In some instances, lightweight polymer materials have been substituted for the aluminum most commonly used to make such adapters. Although lighter in weight, not all of such polymer materials are as strong as aluminum. As a result, adapters made from such materials tend to fail more easily and/or more often than aluminum adapters. Additionally, the desirable physical strength properties of an initially acceptable polymer material may tend to degrade over time. As a result, adapters made from such materials have a shorter service life than aluminum adapters. Further, even in those instances in which polymer materials provide an acceptable level of performance, polymeric adapters tend to be disfavored by the buying public.

Accordingly, there remains a need for an approach which provides adapters with reduced weight, while still maintaining adequate strength and bonding characteristics.

SUMMARY OF THE INVENTION

The present invention provides adapters for mounting an arrow point to an arrow shaft, wherein the inventive adapters advantageously have dramatically reduced weight while still maintaining excellent bonding and structural strength characteristics. The present invention achieves such advantages through the use of an improved glue groove structure which offers significantly higher strength bonding between an adapter and an arrow shaft than can be provided by those glue groove structures used on conventional adapters. The enhanced bonding characteristics of the present invention allow the outside diameter of significant portions of an adapter to be reduced, because a much smaller external surface area of the adapter is needed to achieve an effective level of bonding between an adapter and an arrow shaft. Quite simply, with the approach of the present invention, surface areas of such reduced diameter portions are not needed for bonding engagement. The ability to reduce the diameter of such portions, in turn, allows substantial portions of material to be eliminated from the adapter structure, resulting in dramatic weight savings.

For example, a conventional adapter of the prior art, which is made from aluminum and is adapted to mount arrow points to an arrow shaft in accordance with the AMO Interchangeable Point System Standard, may typically weigh about 52 grains (3.4 g). In contrast, a corresponding adapter of the present invention, which is made from the same aluminum and is adapted for mounting the same arrow point and achieves a comparable level of bonding between the adapter and the arrow shaft, weighs only 26 grains (1.7 g). This is a dramatic 50% weight reduction!

In one aspect, the advantages of the present invention are achieved by an adapter for coupling an arrow point to an arrow shaft, wherein said arrow shaft is of the type having a shaft wall defining an arrow shaft bore at an end portion of the arrow shaft, and wherein the bore has a diameter adapted for receiving the adapter. The adapter comprises a first body member having an exterior surface extending from an inboard end to an outboard end. At least a first portion of the exterior surface of the first body member comprises a groove structure comprising:

(i) a plurality of grooves having a groove density of at least 4 grooves per centimeter; and (ii) a plurality of shoulders spaced apart by said grooves, wherein the ratio of the total cumulative widths of the shoulders of said first portion to the total cumulative width of the grooves of said first portion is in the range of from 0:1 to about 3:1.

The adapter also includes an adapter bore for receiving a mounting portion of the arrow point, wherein at least a portion of the adapter bore is disposed in the first body member. In another aspect, the present invention provides an arrow assembly comprising such an adapter disposed in the arrow shaft bore at one end of an arrow shaft, and an arrow point is received by the adapter.

In another embodiment, the present invention provides an adapter for coupling an arrow point to an arrow shaft, wherein the adapter comprises an exterior surface extending a groove structure having a cube-corner profile. In another aspect, the present invention provides an arrow assembly such an adapter disposed in the arrow shaft bore at one end of an arrow shaft, and an arrow point is received by the adapter.

BRIEF DESCRIPTION OF THE DRAWINGS

The above-mentioned and other features and advantages of this invention, and the manner of attaining them, will become more apparent, and the invention will be better understood, with reference to the following description of preferred embodiments of the invention taken in conjunction with the accompanying drawings, wherein.

Corresponding reference characters indicate corresponding parts throughout the several views. The exemplification set out herein illustrates preferred embodiments of the invention, and such exemplification is not to be construed as limiting the scope of the invention in any manner.

DETAILED DESCRIPTION OF THE PREFERRED EMBODIMENTS

The various aspects of the present invention will now be described with reference to the particular arrow assembly components depicted in FIGS. 1–7. However, the embodiments disclosed below are not intended to be exhaustive or to limit the invention to the precise forms disclosed in the following detailed description.

Figure 1:
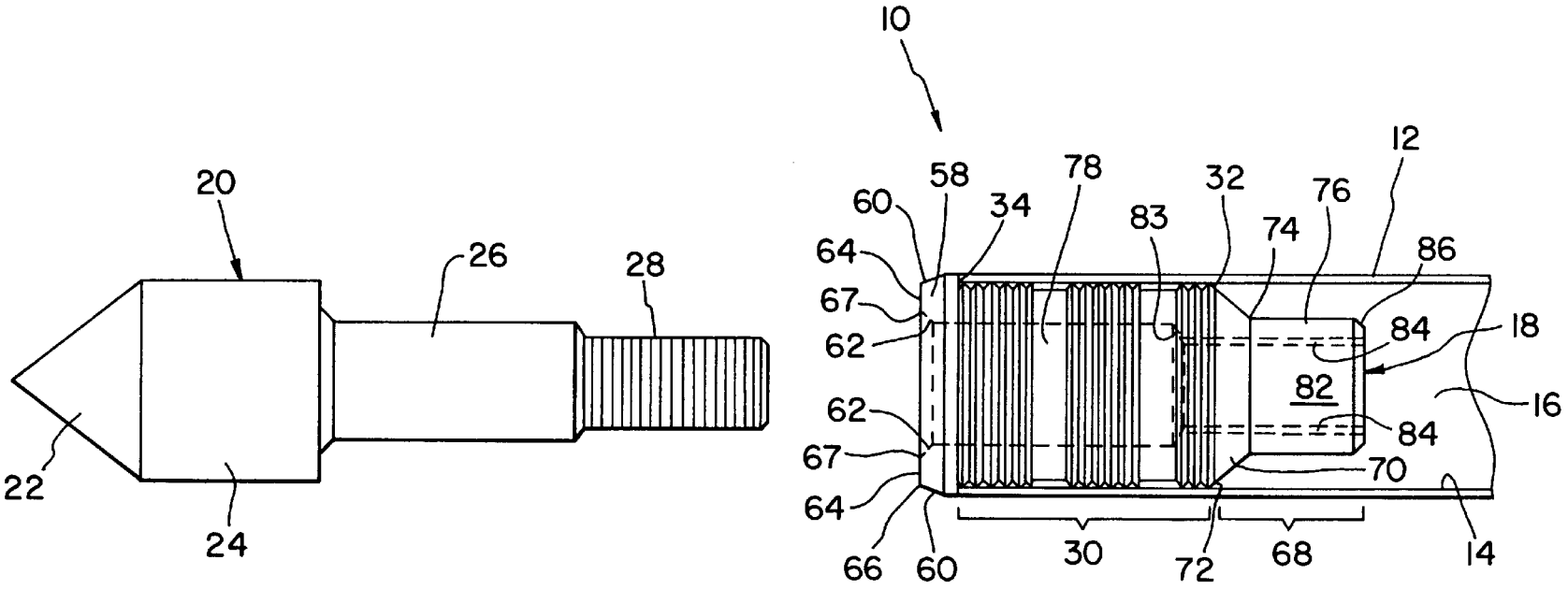
FIG. 1 is a cross sectional view of the end of an arrow assembly having an adapter of the present invention inserted into the end thereof and glued in place.

FIG. 1 shows a front end portion of an arrow assembly 10 of the present invention. Arrow assembly 10 includes a hollow arrow shaft 12 which is shown partially cut away revealing arrow shaft bore 16. Arrow shaft 12 may be fabricated from any suitable arrow shaft material known in the art. Examples of such materials include wood, metal such as aluminum, carbon, fiberglass, composites such as aluminum/carbon, and the like. Of these materials, a metal such as aluminum is preferred.

Adapter 18 is disposed in bore 16 and is used to attach arrow point 20 to arrow shaft 12. Adapter 18 may be made from a suitable lightweight, strong material such as a thermosetting or thermoplastic polymer, graphite, metal, a composite, or the like. In a preferred embodiment, adapter 18 is made from aluminum. Arrow point 20 may have any configuration known in the art to be suitable for arrow points. In the particular embodiment shown in FIG. 1, arrow point 20 is designed to meet the AMO Interchangeable Point System standard. Arrow point 20 is of a type having an integral construction including tip member 22, body member 24, and a mounting portion including shank 26 and threaded extension 28. Shank 26 and threaded extension 28 are received by the adapter 18 for mounting arrow point 20 to arrow shaft 12. Although arrow point 20 is shown having a unitary integral construction, arrow points which are an assembly of various components may also be used in the practice of the present invention.

Figure 2:
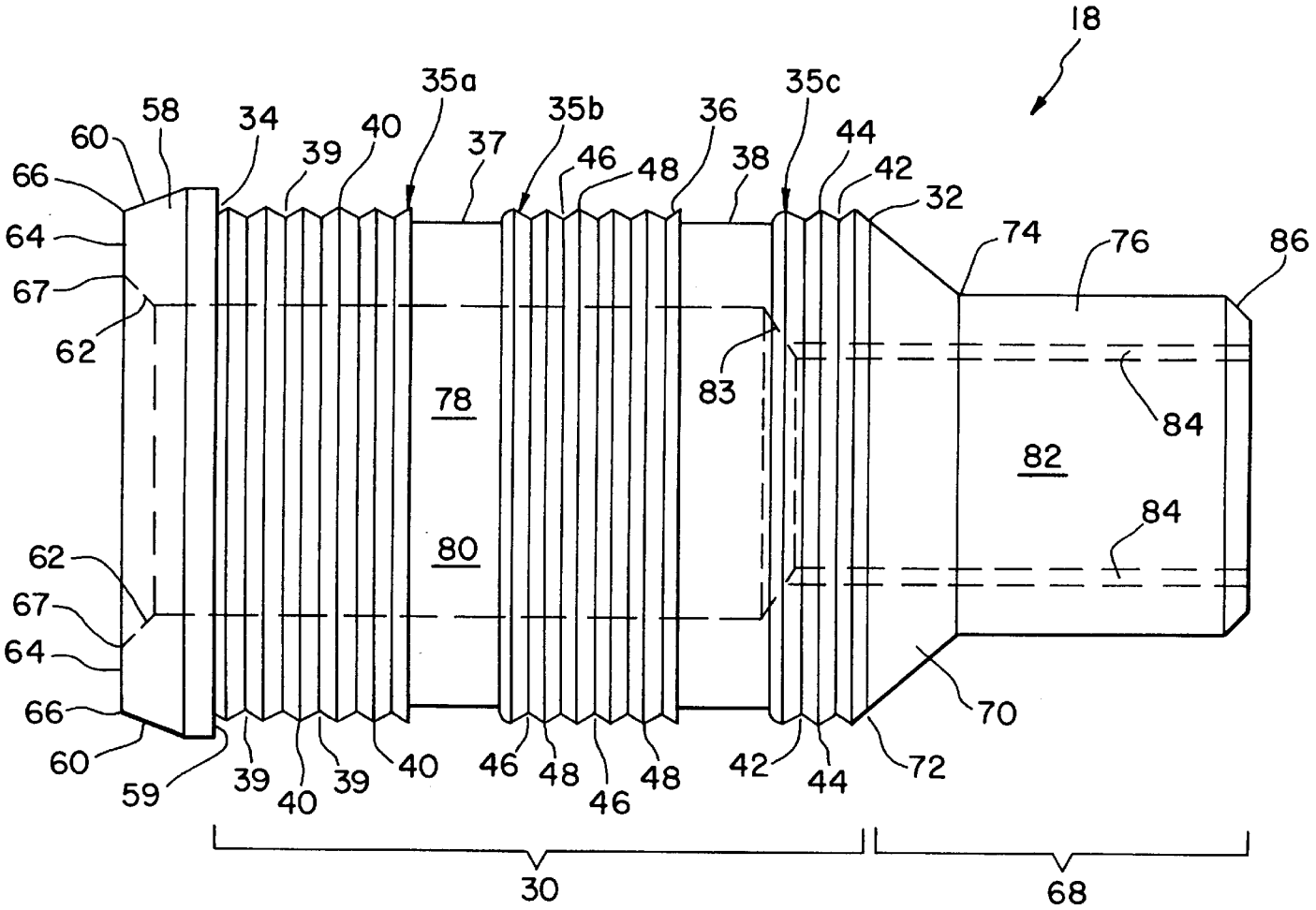
FIG. 2 is a side elevational view of a preferred embodiment of an adapter of the present invention.

Referring now to FIGS. 1 and 2 collectively, adapter 18 includes first body member 30 having an inboard end 32, an outboard end 34, and an exterior surface 36 extending between inboard end 32 and outboard end 34. Advantageously, exterior surface 36 of first body member 30 includes a high density groove structure which enhances bonding between adapter 18 and arrow shaft 12. Because of the high density groove structure of the present invention, less surface area of adapter 18 is needed for bonding engagement with the inside wall 14 of arrow shaft 12. This allows the diameter of substantial portions of the adapter 18 to be reduced, resulting in dramatic weight savings.

The high density groove structure of the present invention may assume a number of different configurations and still be within the scope of the present invention. For example, in one embodiment, a high density groove structure of the present invention comprises a sequence of a plurality of shoulders and a plurality of grooves wherein the grooves have a groove density of at least 4 grooves per centimeter, preferably 4 to about 40 grooves per centimeter, more preferably about from about 8 to about 30 per centimeter, and most preferably from about 10 to about 25 grooves per centimeter. The high density groove structure may be characterized by a ratio of the total cumulative width of the shoulders of the high density groove structure to the total cumulative width of grooves of said structure which is in the range from about 0:1 to about 3:1, more preferably from about 0:1 to about 2:1, and more preferably from 0:1 to about 1:1.

In the particular embodiment shown in FIGS. 1 and 2, the exterior surface 36 of first body member 30 includes three high density groove structures 35*a*, 35*b*, and 35*c* separated by relatively wide grooves, or recesses, 37 and 38. A first high density groove structure 35*a* includes grooves 39 and shoulders 40 adjacent to outboard end 44 of first body member 30. A second high density groove structure 35*c* includes grooves 42 and shoulders 44 adjacent the inboard end 32 of first body member 30. A third high density groove structure 35*b* includes grooves 46 and shoulders 48, which are disposed on exterior surface 36 intermediate inboard end 32 and outboard end 34 of first body member 30. As seen best in FIG. 1, the diameter of any of grooves 39, 42, 46 is reduced relative to the diameter of bore 16 of arrow shaft 12. Recesses 37 and 38 are also characterized by a reduced diameter relative to the diameter of bore 16. As such, the volumes between inside wall 14 and exterior surface 36 provided by such grooves and recesses retain glue (not shown for purposes of clarity) for gluing adapter 18 in place. Grooves 39, 42 and 46 and recesses 37 and 38 are all shown having the same depth, but such depths could be varied if desired. For example, recesses 37 and 38 may have a depth greater than the depth of grooves 39, 42 and 46 and vice versa Further, in the preferred embodiment shown in FIGS. 1 and 2, shoulders 40, 44 and 48 all have an outside diameter which is substantially the same as the diameter of bore 16 of arrow shaft 12 such that shoulders 40, 44 and 48 slidably engage inside wall 14 of arrow shaft 12 as adapter 18 is received by bore 16. Advantageously, shoulders 40, 44 and 48 having such an outside diameter substantially help to maintain proper alignment of adapter 18 in bore 16. Although all of shoulders 40, 44 and 48 are shown having an outside diameter substantially the same as the diameter of bore 16, this is not required in the practice of the present invention. The diameter of any one or more, or even all, of such shoulders may be reduced, if desired.

Referring again to both of FIGS. 1 and 2, adapter 18 includes a flange 58 disposed at outboard end 34 of first body member 30. Flange 58 is provided with an outer diameter greater than the diameter of bore 16 such that flange 58 is prevented from entering arrow shaft bore 16. Thus, flange 58 prevents adapter 18 from sliding too far into bore 16 when adapter 18 is inserted and glued in place. In preferred embodiments, flange 58 has an outer diameter substantially the same as the outside diameter of arrow shaft 12 to provide a streamlined outer surface. Flange 58 further includes outside chamfer 60 and inside chamfer 62 defining outer rim 66 and inner rim 67 of flange face 64. Inside chamfer 62 eases insertion of the mounting portion of arrow point 20 into adapter 18. Outside chamfer 60 is provided primarily for aesthetic reasons. Desirably, outer rim 66 of flange face 64 has the same diameter as the diameter of arrow point body member 24 in order to provide a streamlined connection between flange 58 and arrow point 20. Backside portion 59 of flange 58 abuts the end of arrow shaft 12 when adapter 18 is inserted into bore 16.

Second body member 68 extends from inboard end 32 of first body member 30. As seen best in FIG. 1, second body member 68 has a reduced diameter relative to the diameter of bore 16 such that no portion of the second body member 68 contacts inside wall 14 of arrow shaft 12 when adapter 18 is received in bore 16 of arrow shaft 12. This is the preferred configuration, because the weight of adapter 18 is the smallest when the size of second body member 68 is the smallest. However, portions of the diameter of second body member 68 can be enlarged if desired, although adapter 18 would weigh more if this was done. As shown, second body member 68 includes a substantially conical base 70 tapering from a relatively large diameter at 72 to a relatively small diameter at 74. A cylindrical body portion 76 extends from the relatively small diameter at 74 of conical base 70. The end of cylindrical body portion 76 includes chamfer 86 which eases insertion of adapter 18 into bore 16.

Adapter 18 is provided with bore 78 configured to receive the mounting portion of arrow point 20. In a particular embodiment shown in FIGS. 1 and 2, bore 78 includes a relatively large chamber 80 adapted to receive shank 26 and a relatively small chamber 82 adapted to receive threaded extension 28. Relatively small chamber 82 includes threads schematically represented as 84 corresponding to the threads of threaded extension 28. Bore 78 includes a shoulder portion 83 located at the interface of relatively large chamber 80 and relatively small chamber 82.

As seen best in FIG. 1, a suitable glue, for example hot melt adhesive, may be disposed in grooves 39, 42 and 46 and recesses 37 and 38 to bond adapter 18 to inside wall 14 of arrow shaft 12. The high density groove structure of the present invention enhances bonding to such a degree that no other glue is required other than glue which may be disposed between first body member 30 and the inside wall 14 of arrow shaft 12. Advantageously, therefore, no glue is needed between second body member 68 and inside wall 14 of arrow shaft 12. Of course, glue could be used between second body member 68 and inside wall 14, if desired, but this is not required and would unnecessarily add weight to arrow assembly 10.

Figure 3:
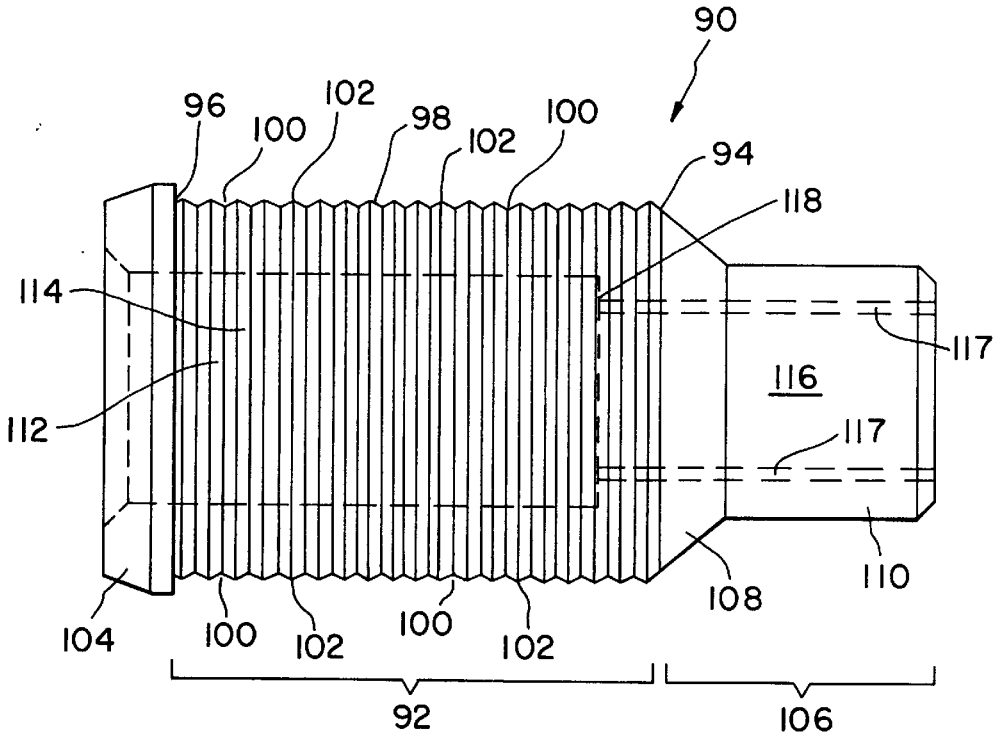
FIG. 3. is a side elevational view of an alternative embodiment of an adapter of the present invention.

FIG. 3 shows an alternative embodiment of an adapter 90 which includes first body member 92 having exterior surface 98 extending from inboard end 94 to outboard end 96. Adapter 90 includes a high density groove pattern extending across substantially all of exterior surface 98. The groove pattern includes grooves 100 and shoulders 102. Flange 104 is disposed at the outboard end 96 of first body member 92. Second body member 106 extends from the inboard end 94 of first body member 92 and includes conical base 108 and cylindrical body member 110. Adapter 90 is provided with bore 112 for receiving the mounting portion of an arrow point. Bore 112 includes relatively large chamber 114 and relatively small chamber 116. Bore 112 includes shoulder portion 118 at the interface between relatively large chamber 114 and relatively small chamber 116. Relatively small chamber 116 includes threads, shown schematically at 117, for engaging corresponding threads of the mounting portion of an arrow point.

Figure 4:
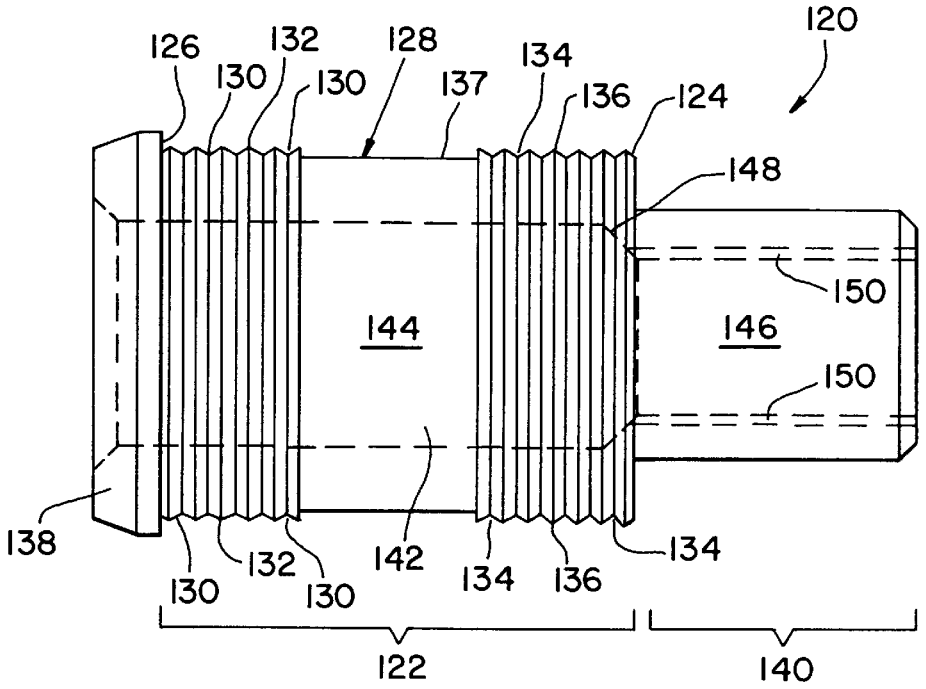
FIG. 4 is a side elevational view of another alternative embodiment of an adapter of the present invention.

FIG. 4 shows an alternative embodiment of an adapter 120 in accordance with the present invention. Adapter 120 includes first body member 132 having an exterior surface 128 extending from inboard end 124 to outboard end 126. Exterior surface 128 includes a first high density groove structure adjacent the outboard end 126 of first body member 122 comprising grooves 130 and shoulders 132. A second high density groove structure is provided adjacent inboard end 124 of first body member 132 and comprises grooves 134 and shoulders 136. Relatively wide groove or recess 137 separates grooves 130 and shoulders 132 from grooves 134 and shoulders 136. Second body member 140 extends from the inboard end 124 of first body member 122. Adapter 120 is provided with a bore 142 configured to receive the mounting portion of an arrow point such as arrow point 20 shown in FIG. 1. Bore 142 includes a relatively large chamber 144 and a relatively small chamber 146. Shoulder portion 148 is located at the interface of relatively large chamber 144 and relatively small chamber 146. Relatively small chamber 146 includes threads, shown schematically at 150, for engaging corresponding threads of the mounting portion of an arrow point.

Figure 5:
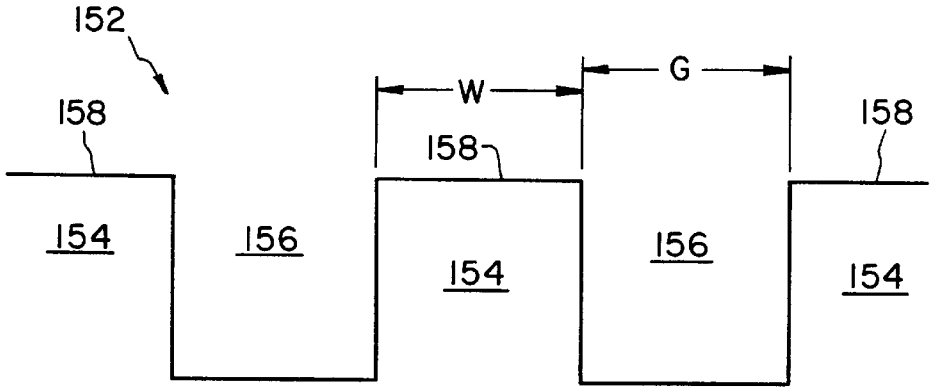
FIG. 5 is a side view of a groove structure profile useful in the practice of the present invention.
Figure 6:
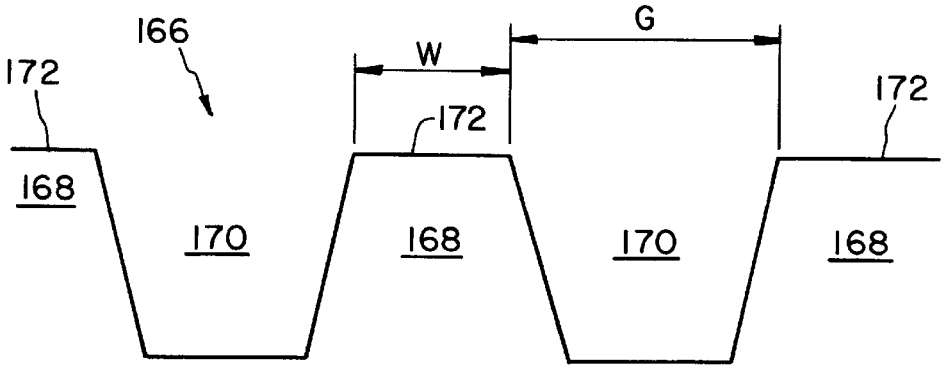
FIG. 6 is a side view of a groove structure profile useful in the practice of the present invention.

In the practice of the present invention, the width of a shoulder of a high density groove structure means the width of the face of the shoulder which is disposed toward the inside wall 14 of arrow shaft 12. The width of a groove of a high density groove structure means the distance across the volume between shoulder faces which define the groove. For example, FIG. 5 shows a groove structure 152 comprising a plurality of shoulders 154 and a plurality of grooves 156. Each of the shoulders 154 include a face 158 which would be disposed toward the inner wall of an arrow shaft. The width of any such shoulder 154 would be represented by the dimension W and the width of any groove 156 would be represented by the dimension G. As another example, an alternative groove structure 166 is shown in FIG. 6 comprising a plurality of shoulders 168 and a plurality of grooves 170 wherein the shoulders include corresponding faces 172. In this kind of embodiment, the width of the shoulder would be deemed to be represented by the dimension W and the width of a groove would be represented by the dimension G.

Figure 7:
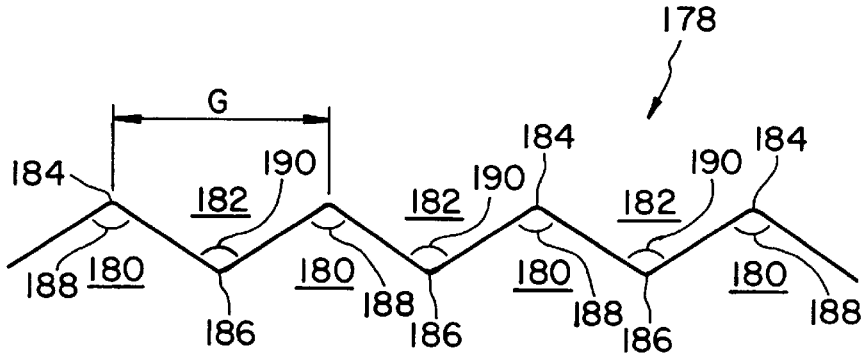
FIG. 7 is a side view of a groove structure profile useful in the practice of the present invention.

FIG. 7 shows the groove structure profile of a particularly preferred high density groove structure 178 of the present invention. High density groove structure 178 has a cube-corner profile comprising an alternating sequence of shoulders 180 and grooves 182. Each of shoulders 180 has a corresponding shoulder peak 184 and each of grooves 182 has a corresponding groove peak 186. Shoulder peak angles 188 and groove peak angles 190 each may independently be an angle in the range from about 30° to about 140° and more preferably from about 60° to about 120°, and most preferably of about 90°. All of the shoulder peak angles 188 may be the same or different and/or all of the groove peak angles 190 may be the same or different. Preferably, all of peak angles 188 and groove peak angles 190 are the same. For purposes of calculating the ratio of the width of a shoulder to the width of a groove of a groove structure having a cube corner profile, the width of a shoulder peak is negligible and therefore is deemed to be zero. On the other hand, the width of a groove of such a structure would be defined by the distance represented by G which extends from one shoulder peak to the next contiguous shoulder peak.

Cube-corner groove structures provide exceptional bonding strength for a given surface area The shoulder peaks help align an adapter in an arrow shaft, yet occupy negligible surface area. Glue groove surface area is thereby maximized.

While this invention has been described with respect to preferred embodiments, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. An adapter for coupling an arrow point to an arrow shaft, wherein said arrow shaft is of the type having a shaft wall defining an arrow shaft bore at an end portion of the arrow shaft, wherein the bore has a diameter adapted for receiving the adapter, and wherein said adapter comprises:

a first body member having an exterior surface extending from an inboard end to an outboard end, wherein at least a first portion of the exterior surface of the first body member comprises a groove structure comprising a plurality of grooves having a groove density of at least 4 grooves per centimeter and a plurality of shoulders spaced apart by said grooves, wherein the ratio of the total cumulative widths of the shoulders of said first portion to the total cumulative width of the grooves of said first portion is in the range of from 0:1 to about 3:1;

an adapter bore for receiving a mounting portion of the arrow point, wherein at least a portion of said adapter bore is disposed in the first body member; and a second body member extending from the inboard end of the first body member and comprising a substantially conical base tapering from a relatively large diameter adjacent the first body member to a relatively small diameter distal from the first body member, and a cylindrical body portion extending from the relatively small diameter of the conical base.

2. The adapter of claim 1, wherein at least a portion of said second body member has a reduced diameter relative to the diameter of the arrow shaft bore such that said reduced diameter portion does not contact the inside wall surface of the arrow shaft when the adapter is received by the arrow shaft.

3. An arrow assembly, comprising:

an arrow shaft comprising a tubular shaft wall defining an arrow shaft bore at an end portion of the arrow shaft, wherein said arrow shaft bore has a bore diameter;

an adapter disposed in the arrow shaft bore, comprising a first body member having an exterior surface extending from, an inboard end to an outboard end, wherein at least a first portion of the exterior surface of the first body member comprises a groove structure comprising a plurality of grooves having a groove density of at least 4 grooves per centimeter and a plurality of shoulders spaced apart by said grooves, wherein the ratio of the total cumulative widths of the shoulders of said first portion to the total cumulative width of the grooves of said first portion is in the range of from 0:1 to about 3:1;

an arrow point receiving adapter bore, wherein at least a portion of said adapter bore is disposed in the first body member;

a second body member extending from the inboard end of the first body member, the second body member comprising a substantially conical base tapering from a relatively large diameter adjacent the first body member to a relatively small diameter distal from the first body member, and wherein said second body member comprises a cylindrical body portion extending from the relatively small diameter of the conical base; and an arrow point comprising a mounting portion wherein said mounting portion is disposed in the adapter bore of the adapter.

4. The arrow assembly of claim 3, wherein at least a portion of said second body member has a reduced diameter relative to the diameter of the arrow shaft bore such that said reduced diameter portion does not contact the inside wall surface of the arrow shaft when the adapter is received by the arrow shaft.

* * * * *